US005127993A

United States Patent [19]

Chen

[11] Patent Number: 5,127,993

[45] Date of Patent: * Jul. 7, 1992

[54] METHOD OF ENHANCING GREEN LIQUOR SEMI-CHEMICAL PULP PRODUCTION

[75] Inventor: Cheng-I Chen, Jacksonville, Fla.

[73] Assignee: Betz PaperChem, Inc., Jacksonville, Fla.

[ * ] Notice: The portion of the term of this patent subsequent to Mar. 6, 2007 has been disclaimed.

[21] Appl. No.: 463,084

[22] Filed: Jan. 10, 1990

[51] Int. Cl.[5] ..... D21C 3/20

[52] U.S. Cl. ..... 162/72; 162/82; 162/77

[58] Field of Search ..... 162/72, 77, 82

[56] References Cited

U.S. PATENT DOCUMENTS 2,999,045 7/1961 Mitchell et al. ..... 162/72 X
3,909,345 9/1975 Parker et al. ..... 162/72
4,906,331 3/1990 Blackstone et al. ..... 162/72.

OTHER PUBLICATIONS

Pluronic Polyol Literature (date of publication not know).

*Primary Examiner*—Thi Dang
*Attorney, Agent, or Firm*—Alexander D. Ricci; Richard A. Paikoff

[57] ABSTRACT

The present invention is directed to the use of certain ethoxylated compounds to increase the yield of green liquor semi-chemical pulping processes, the compound have the following structures:

$$HO(CH_2CH_2O)_a(CHCH_2O)_b(CH_2CH_2O)_cH$$
$$CH_3$$

11 Claims, No Drawings

METHOD OF ENHANCING GREEN LIQUOR SEMI-CHEMICAL PULP PRODUCTION

BACKGROUND OF THE INVENTION

The present invention relates to the production of wood pulp by the green liquor semi-chemical pulping method. Green liquor semi-chemical pulping is a two-stage process. It uses green liquor cooking to soften the wood chips and mechanical refining to disintegrate the cooked chips into individual fibers. The present invention utilizes surface active agents having the following general structure:

$$HO(CH_2CH_2O)_a(CHCH_2O)_b(CH_2CH_2O)_cH$$

$$CH_3$$

wherein a, b, and c are at least 1 but are such to produce an agent having a molecular weight of 500 to 30,000 with those having a molecular weight of 1,000 to 10,000 being preferred. The surface active agent is added during the green liquor semi-chemical pulping process.

Green liquor typically consists of $Na_2S$, $Na_2CO_3$, and water. It is used to weaken the intercellular bonding by partial removal of hemicellulose and lignin. The more green liquor that is used, the more hemicellulose and lignin are removed, resulting in less mechanical energy required to refine the cooked chips. This energy savings is counter-balanced because the more hemicellulose and lignin that are removed, the lower the pulp yield. Conversely, the less green liquor used, the more mechanical energy is required and the higher the pulp yield. It is an object of this invention to increase the pulp yield by reducing the green liquor amount without increasing the mechanical energy.

U.S. Pat. No. 3,909,345 discusses and claims the use of surface active agents having the general formula:

$$R[(C_2H_4O)n\ (C_3H_6O)m)]y\ H$$

as additives to sulfate cooking liquor aids for the purpose of obtaining higher yields of pulp from a given wood chip charge. These agents permit a greater effectiveness of the cooking process relative to chips which prior to that invention were considered rejects and not pulpable.

While there is a degree of similarity between the invention of the '345 patent and that of the present inventors, the similarities cease as regards to the type of surface active agent utilized and the type of pulping process utilized.

The present invention utilizes surface active agents having the general structure:

$$HO(CH_2CH_2O)_a(CHCH_2O)_b(CH_2CH_2O)_cH$$

$$CH_3$$

wherein a, b, and c are at least 1 but are such to produce an agent having a molecular weight of 500 to 30,000 with those having a molecular weight of 1,000 to 10,000 being preferred.

The green liquor semi-chemical pulping process differs from the kraft or sulfate pulping process described in the '345 patent. The kraft pulping process is a wholly chemical approach to pulping. Through the use of heat, pressure and chemicals the wood chips are disintegrated into fibers by cooking for about one hour for eventual use as linerboard for example. The typical chemicals utilized are sodium hydroxide (NaOH) and sodium sulfide ($Na_2S$). In contrast, green liquor semi-chemical pulping is a two step process. The wood chips are first softened by the chemical processing involving about a twenty (20) minute cooking time then the softened wood chips are fiberized utilizing mechanical energy for eventual use as corrugated medium in boxboard for example. The typical chemicals comprising the green liquor which is used for softening the wood chips are sodium carbonate ($Na_2CO_3$) and sodium sulfide ($Na_2S$).

DESCRIPTION OF THE INVENTION

The present invention utilizes surface active agents having the general structure:

$$HO(CH_2CH_2O)_a(CHCH_2O)_b(CH_2CH_2O)_cH$$

$$CH_3$$

wherein a, b, and c are at least but are such to produce an agent having a molecular weight of 500 to 30,000 with those having a molecular weight of 1,000 to 10,000 being preferred.

As with the '345 patent, the present surface active agents or combination thereof may be added to the green liquor prior to contact of such with the chips in an amount of about 0.001 to 1% based upon the dry weight of the wood chips. Preferably about 0.01 to 0.5% of the surface active agents based upon the dry weight of the wood chips is added to the green liquor. The surface active agents used in accordance with the present invention are available from BASF Wyandotte Corp., under trade names such as Pluronic L-62, L-92 and F-108.

The present invention is particularly suitable in green liquor semi-chemical pulp production by reducing the use of cooking liquor and amount of refining and increasing the yield from the pulping process.

From the available literature on the Pluronics, it was determined that:

L-62 had a molecular weight of approximately 2,188 and was composed of approximately 20% ($CH_2CH_2O$) and approximately 80%

$$\begin{array}{l} | \\ (CH_2CH_2O) \\ | \\ CH_3 \end{array}$$

L-92 percentages were respectively about 20% and 80% with a molecular weight of 3,440; and F-108 had percentages of 80% and 20% respectively with a molecular weight of 16,250.

In semi-chemical pulping, the pulping process is usually terminated when the amount of rejects in the pulp is reduced to an acceptable level. Substantial yield and quality advantages can be obtained when chips are processed to a higher lignin content.

Substantial economic benefits can be realized if increased yield can be accomplished while decreasing the amount of refining energy and decreasing the amount of green liquor utilized.

EXPERIMENTAL

The following mill study and results demonstrate the effectiveness of certain surfactants and blends thereof as pulping additives during green liquor semi-chemical pulping.

A semi-chemical pulp mill using waste kraft paper and semi-chemical pulp to manufacture corrugated medium will spend $140/ton and $55/ton, respectively on these two furnishes. For this reason there is a strong economical incentive to increase the use of semi-chemical pulp. The semi-chemical pulp mill was designed to process 500 tons/day but is used to process 550-575 tons/day and consequently, is short of cooking liquor. The mill uses green liquor to cook the chips for about 22.5 minutes. The cooked chips are then refined and washed.

A product comprised on an active basis of an aqueous solution containing 10% Pluronic L-62 and 7-½% Pluronic F-108 was added to the wood chips prior to cooking at a rate of about 2 lb/ton based on the pulp production. The mill produced green liquor semi-chemical pulp utilizing wood chips being pulped at the following conditions.

Cooking time: about 22.5 minutes

Cooking temperature: about 250° F.–350° F.

Green liquor: about 160 gal/min

Chips: about 670 tons/day at 45% moisture

At 2.62 horsepower day (HPD)/ton, the typical refining energy of the mill, the percentage of rejects before treatment with the composition of the present invention was 8.7%. After treatment with the present invention the percentage of rejects was 7.2%. This 1.5% reject reduction based on pulp was equivalent to a 17% reduction based on rejects.

The lower reject levels indicated that the chips were better penetrated by green liquor.

The refining energy at both pulp mill and paper mill was lower during the trial.

| | Pulp Mill + | Paper Mill = | Overall |
|---|---|---|---|
| Pre-Trial | 2.62 | 7.39 | 10.01 |
| Trial | 2.35 | 5.61 | 7.96 |
| Difference | | | 2.05 HPD/ton |

The refining energy saving of 2.05 HPD/ton was estimated to be about $300,000/year.

The refining energy reduction was another indication that the chips were better penetrated by the green liquor.

Since chips were better penetrated by the green liquor, the green liquor dosage was reduced by 5 gal/min. The 5 gal/min reduction was equivalent to 3% of the overall green liquor dosage.

The reduction of the green liquor dosage resulted in increasing the yield from 72.7 to 75.1% based on oven dried weight of the chips. The yield increase was estimated to be 6,454 tons of pulp per year.

The 5 gal/min green liquor reduction was equivalent to a savings of 2.5 million gal/year.

In summary, the addition of the present invention reduced the use of cooking liquor and refining energy, and increased the yield of the green liquor semi-chemical pulping.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What I claim is:

1. A process for enhancing the production of wood pulp from wood chips utilizing green liquor semi-chemical pulping comprising adding to wood chips a combination of green liquor and a sufficient amount of a surface active agent having the general formula:

$$HO(CH_2CH_2O)_a(\underset{\underset{CH_3}{|}}{C}HCH_2O)_b(CH_2CH_2O)_cH$$

wherein a, b, and c are each at least 1 and are such as to provide the compound with a molecular weight of about 500 or higher, thereby increasing the pulp yield while decreasing the amount of green liquor utilized.

2. The method according to claim 1 wherein said agent has a molecular weight of from about 500 to about 30,000.

3. The method according to claim 2 wherein said agent has a molecular weight of from about 1,000 to about 10,000.

4. The method according to claims 1, 2, or 3 wherein said agent is added to said green liquor prior to contact of said green liquor with said chips.

5. The method according to claim 4 wherein said agent is added in an amount from about 0.001 to 1 percent of the dry weight of said chips.

6. The method according to claim 5 wherein said agent is added in an amount from about 0.01 to 0.5 percent of the dry weight of said chips.

7. A process for enhancing the production of wood pulp from wood chips utilizing green liquor semi-chemical pulping comprising adding to wood chips a combination of green liquor and a sufficient amount of a surface active agent having the general formula:

$$HO(CH_2CH_2O)_a(\underset{\underset{CH_3}{|}}{C}HCH_2O)_b(CH_2CH_2O)_cH$$

wherein a, b, and c are each at least 1 and are such as to provide the compound with a molecular weight of about 500 to about 30,000 and such that $(CH_2CH_2O)$ comprises from about 20 to 80 percent by weight of said agent, thereby increasing the pulp yield while decreasing the amount of green liquor utilized.

8. The method according to claim 7 wherein a, b, and c have values such that said agent has a molecular weight of from about 1,000 to 10,000.

9. The method according to claims 7 or 8, wherein said agent is added to said green liquor prior to contact of said green liquor with said chips.

10. The method according to claim 9 wherein said agent is added in an amount from about 0.001 to 1 percent of the dry weight of said chips.

11. The method according to claim 10 wherein said agent is added in an amount from about 0.01 to 0.5 percent of the dry weight of said chips.

* * * * *